US006655047B2

(12) United States Patent
Miller, II

(10) Patent No.: US 6,655,047 B2
(45) Date of Patent: Dec. 2, 2003

(54) FIRE ARRESTER FOR USE WITH A CLOTHES DRYER

(76) Inventor: Andrew C Miller, II, 315 Mallard Dr., Chapin, SC (US) 29036

( * ) Notice: Subject to any disclaimer, the term of this patent is extended or adjusted under 35 U.S.C. 154(b) by 0 days.

(21) Appl. No.: 10/128,096

(22) Filed: Apr. 23, 2002

(65) Prior Publication Data

US 2002/0184786 A1 Dec. 12, 2002

Related U.S. Application Data

(60) Provisional application No. 60/286,902, filed on Apr. 27, 2001.

(51) Int. Cl.[7] ..... F26B 21/06

(52) U.S. Cl. ..... 34/544; 34/89; 34/90; 34/551; 34/595; 34/607

(58) Field of Search ..... 34/595, 598, 599, 34/544, 551, 604, 607, 89, 90

(56) References Cited

U.S. PATENT DOCUMENTS

| | | | | | |
|---|---|---|---|---|---|
| 3,547,201 | A | | 12/1970 | Balmes, Sr. | 169/26 |
| 4,177,461 | A | | 12/1979 | Brown et al. | 340/628 |
| 4,324,138 | A | * | 4/1982 | Davis et al. | 374/111 |
| 4,930,579 | A | | 6/1990 | George | 169/54 |
| 4,995,172 | A | | 2/1991 | Friedrichs | 34/255 |
| 5,396,715 | A | | 3/1995 | Smith | 34/261 |
| 5,548,904 | A | * | 8/1996 | Rood | 34/82 |
| 5,564,831 | A | | 10/1996 | Bashark | 374/141 |
| 5,606,804 | A | | 3/1997 | Smith et al. | 34/261 |
| 5,675,912 | A | | 10/1997 | Thompson | 34/494 |
| 5,686,885 | A | * | 11/1997 | Bergman | 340/514 |
| 6,125,759 | A | | 10/2000 | Epps | 101/484 |
| 6,356,426 | B1 | * | 3/2002 | Dougherty | 361/102 |

OTHER PUBLICATIONS

The Consumer Product Safety Commission website, at http://www.cpsc.gov/cpscpub/pubs/5022.html, for the information that it provides regarding fires caused by overheated clothes dryers. The associated website page accompanying this document was printed on Mar. 16, 2002.

The Underwriters Laboratories Inc. website at http://www.ul.com/auth/tca/v8n2/, for the information that it provides regarding safety standards for clothes dryers. The associated website contained the following copyright notice © 2002 Underwriters Laboratories Inc.

Information from the Consumer Product Safety Commission's 2000–Annual Report to Congress, which is being submitted for Item 15, which has been enclosed. This is a 200 page document. Due to its size, it is contained within a floppy disk accompanying this document and is saved as a .PDF file, which can be opened and viewed using an Adobe® Acrobat® reader. The information can also be found at: http://www.cpsc.gov/cpscpub/pubs/reports/2000rpt.pdf.

* cited by examiner

*Primary Examiner*—Ira S. Lazarus
*Assistant Examiner*—Kathryn S. O'Malley
(74) *Attorney, Agent, or Firm*—Michael A. Mann; William Y. Klett, III; Nexsen Pruet Jacobs & Pollard, LLC

(57) ABSTRACT

A fire arrester for use with a clothes dryer includes a fire detector at the dryer vent to detect fires starting in the dryer and provides an electrical power disconnect means to break the flow of electrical power being supplied to operate the dryer. Optionally, the signal is applied to release an extinguishing agent or fire suppressant into the interior of the dryer just prior to shutting off the dryer blower. The output signal from the fire detector can also be used to provide various alarms, including local visual and/or alarms, as well as a remote alarm, which can be accomplished by sending a signal to a remote monitoring facility such as a home intrusion service or to a local fire department. Optionally, the activation of any of the alarm signals, and/or the activation of any of the features or functions of the fire arrester can be accomplished by using wireless communications.

12 Claims, 2 Drawing Sheets

FIRE ARRESTER FOR USE WITH A CLOTHES DRYER

CROSS REFERENCE TO RELATED APPLICATIONS

This application claims the benefit of U.S. Provisional Application No. 60/286,902, filed on Apr. 27, 2001, which is incorporated herein by reference. Applicant claims the priority date benefits of that application.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISK APPENDIX

Not Applicable.

BACKGROUND OF THE INVENTION

The present invention relates generally to fire prevention and in particular to improvements in appliances in order to prevent or arrest fires starting as a result of the operation of the appliances. Fires that occur in homes can be started by a number of factors. One of the causes of household fires is a malfunctioning clothes dryer, and the U.S. Consumer Product Safety Commission has estimated that clothes dryers cause more than 15,000 fires each year. Most dryers operate on electricity and draw significant amounts of electrical current to produce the heat needed for drying the clothes and for rotating the drying drum, while other dryers use gas to provide the heat. In each case, most dryers have an internal safety mechanism that will interrupt the power to the heating elements in case of a malfunction of the heating elements. Unfortunately, some fires will not be prevented or controlled by these internal safety mechanisms alone. For example, a fire could damage the mechanism before it can become activated, and, even if activated, the interruption of power alone may not be enough to prevent or control the fire. Finally, an internal safety mechanism alone generally does nothing to alert the dryer operator or others of the presence of a fire. An example of a fire protection device that can be used with a clothes dryer is described in the patent to George (U.S. Pat. No. 4,930,579). This patent describes an automatic sprinkler head system that, when activated, sprays water over the entire area in which it is located, which may cause a significant amount of water damage to that area. Other examples of clothes dryers that incorporate fire protection are disclosed in the patents to Smith (U.S. Pat. Nos. 5,396,715 and 5,606,804). These patents, however, are primarily directed for use with a microwave dryer, and, arguably, include a complicated monitoring system and water as the extinguishing agent, which may not be practical for use with many of the conventional gas or electric dryers already in service. Therefore, a need still remains for a relatively simple device that can arrest or extinguish a fire, remove the usual source of heat, and alert the user and others of a dryer fire.

BRIEF SUMMARY OF THE INVENTION

According to its major aspects and briefly recited, the present invention is an improvement to clothes dryers that may stop a fire before it has developed into a conflagration and, in an alternative optional embodiment, put the fire out and provide a remote alarm. The invention includes a fire detector at the dryer exhaust that shuts down the dryer after detecting the presence of a fire, and, in an alternative embodiment, the fire detector signal is also used to release an extinguishing medium into the air intake or into the internal volume of the dryer itself to suffocate the fire, and/or to reduce the temperature of the environment below the temperature needed to sustain combustion of the source of fuel for the fire. Another alternative embodiment includes additional alarm features that are also activated by the fire detector.

An important feature of the invention is the use of a fire or smoke detector to control the operation of a malfunctioning dryer including, but not necessarily limited to, assuring that the malfunctioning dryer is shut down. An advantage of this feature is that it allows for the removal of the electrical power and/or the supply of gas to the heat source while also possibly providing for the possibility of allowing the blower/fan to continue operating so that an extinguishing medium can be pulled through the dryer.

Another important feature of the present invention is the combination of a fire extinguishing means, such as carbon dioxide or other suitable extinguishing media, and a fire or smoke detector, to both detect and put out a fire in a dryer or other appliance.

Another important feature of the present invention is the use of an alarm to notify the local user of the dryer of the existence or possibility of a fire, and/or to provide remote notification to others, for example, to an alarm-monitoring service.

Other features and their advantages will be apparent to those skilled in the art of appliance design and operation from a careful reading of the Detailed Description of the Invention, accompanied by the drawings.

DETAILED DESCRIPTION OF THE INVENTION

Figure 1:
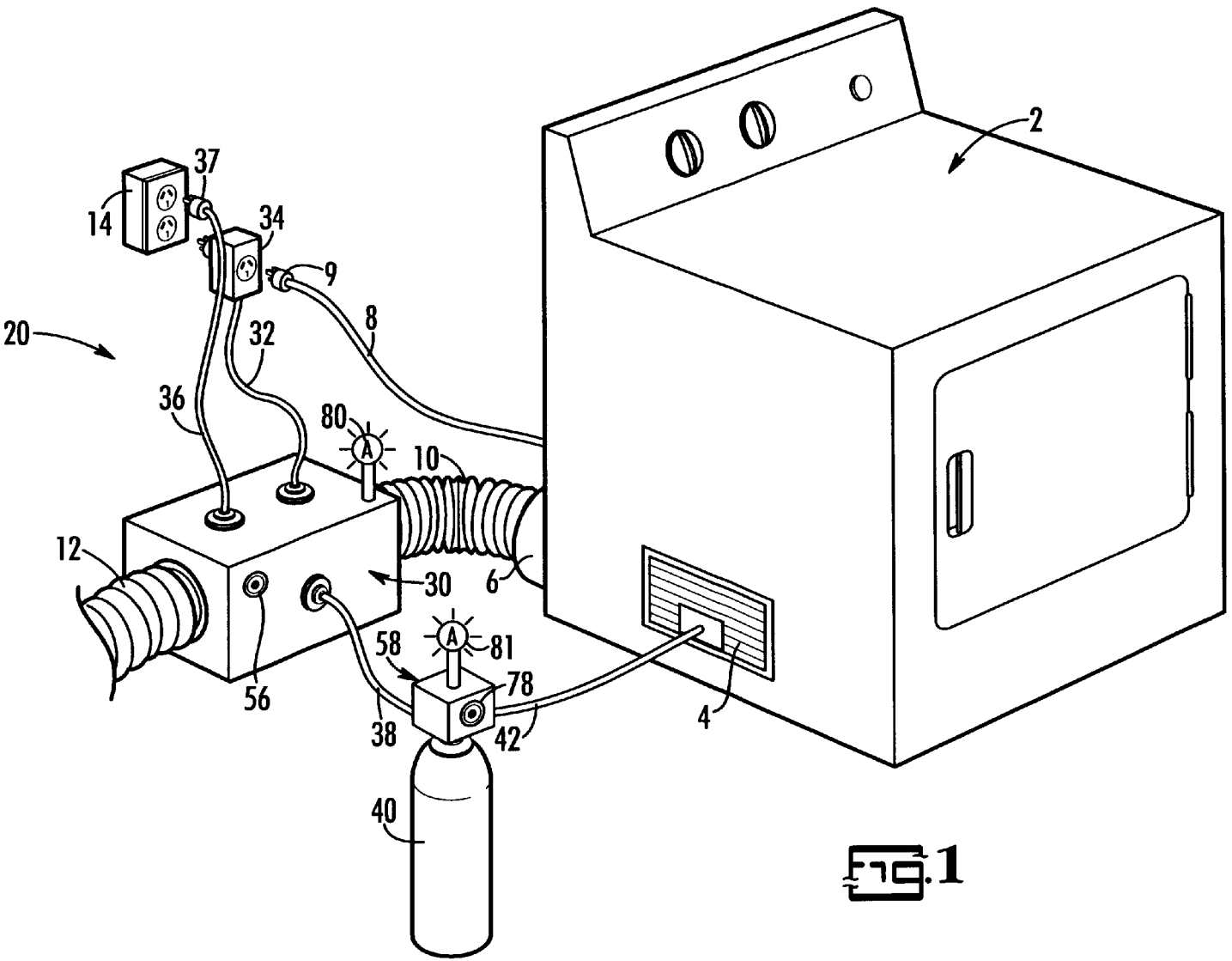
FIG. 1 is a schematic view of a fire arrester for a clothes dryer according to a preferred embodiment of the present invention.

The present invention is a fire arrester for use with a clothes dryer, either gas or electric, and also an improved clothes dryer. "Fire arrester" does not mean that the device will prevent a fire but it does mean that, if one begins, it will tend to stop it, limit the damage as a result of it, and, in a preferred alternative embodiment, possibly put it out promptly.

Preferably, the present fire arrester includes a fire detector, which can be attached at the exhaust vent and/or the exhaust hose of a dryer; the external exhaust vent, which is generally located on the exterior of the building; positioned within the dryer and/or the dryer's exhaust hose; and/or is otherwise located between the exhaust vent of the dryer and the exterior external vent. Preferably, the detector is adapted to mate with the air exhaust vent of a clothes dryer, or with the exhaust hose of a clothes dryer. This allows the detector to be in contact with the dryer's airflow path. Another preferred embodiment of the fire arrester uses more than one fire detector, and has the detectors located along the ventilation and/or exhaust path so that each detector covers at least one section of that path.

The use of the term "fire detector" herein, includes within its meaning smoke detectors as well as other fire sensing devices. One of the earliest indicators of the presence of a fire, however, is the release of smoke. Consequently, a fire detection system that detects smoke can be effective in the early detection of fire. Moreover, smoke detection technology is quite mature. Generally, smoke detectors have two basic parts: a sensor that detects smoke and an alarm that warns of the presence of smoke. Typically, a photoelectric sensor and/or an ionization sensor is incorporated into a smoke detector, and may include those sensors that sense increased particulate as well as those that chemically detect the products of combustion. Additionally, the ability to use smoke detectors in air ducts makes this a type of detector that is compatible with the environment associated with a dryer's exhaust, namely, an environment having a high air velocity, a high temperature, high humidity, and is dust and/or lint filled. Furthermore, smoke detection is generally more preferable than other detection means.

With respect to preferability, thermal detection is less preferred than smoke detection because the normal exhaust temperature of a clothes dryer varies throughout the drying cycle, and the temperature threshold associated with a hazardous condition is also likely to vary, which can become problematic. More specifically, the monitoring of the exhaust temperature of the dryer for the presence of a fire would require a complex, real-time determination of the normal temperature of the exhaust gas and a comparison between that temperature and the actual exhaust gas temperature. Moreover, an increase in temperature sufficient to cause a detectable and reliable signal for detection and response can only occur after the fire has progressed sufficiently, which may result in significant damage prior to a response, and which makes such an approach unrealistically complex and unreliable.

Likewise, chemical detection of particular combustion and/or exhaust gases is also less preferred than smoke detection. Notably, the sensors used for chemical detection applications are typically more complex and more expensive in comparison to those found in commercially available smoke detectors. Also, a wide variety of chemicals are present in laundry products that may cause false alarms for chemical detectors. Compounding this is the knowledge that a large number of different chemicals could be present in the combustion gases associated with a dryer fire, which generally dictates that an array of sensors must be used in a chemical detection method detector for it to work properly, while in a detector using smoke detection only a single sensor may be required.

Regardless, the present invention may use a variety of sensor types to activate the present invention detector upon contact with heat, smoke, certain chemicals, or any other stimuli; however, for the aforementioned reasons, the preferred activation stimuli of the detector is smoke. As a result, the present invention preferably uses, but is not limited to, a smoke sensor as the detection means for the detector in order to sense the presence of a fire.

In commercially available smoke detectors, the output signal of the sensor is normally only routed to an audible alarm. In the present invention, however, the output signal from the detector is routed to a variety of response means. Such response means serve to activate the various desired features and/or functions of the fire arrester. For example, the detector can send an output signal to a response means that provides a local alarm, which may be audible and/or optical, as part of the present invention fire arrester. Furthermore, in a preferred alternative embodiment and as an additional feature of the response means, the output signal is used to communicate, through either a hard-wired or a wireless communication means, to or with a remote monitoring service. Such a remote monitoring service can include, but is not limited to, a home intrusion monitoring service; however, any other suitable service including, but not limited to, a signal being directly transmitted to the user's local fire department can be used as well. This feature offers additional protection for the owner in case of fire: the fire department can be automatically notified in case of fire, and/or the owner can be notified of the presence of a hazardous condition within the dryer, even while away from home, for example, by having the remote monitoring service call the user's work or cell phone number. In other words, the output signal(s) from the detector can be used to activate a local alarm and/or a remote alarm as a part of the response to the detection of a fire, and all, or part, of the output and/or response signals can be communicated through the use of wireless communications technology.

Another feature of the response means is the inclusion of an electrical power disconnect means. When used herein any of the forms of the terms "interrupt" and "disconnect" can be taken to mean "to break the source of power to the dryer," and they both can be construed as being interchangeable. The present invention disconnect means serves to disconnect the supply of power to the dryer upon receipt of a signal from the detector. Generally, in an electric dryer the disconnection of power will cause the heating element to become de-energized while in a gas dryer the disconnection of power will de-energize and close the gas supply solenoid valves—these valves normally only supply gas to the gas dryer's burner unit if they are energized. The electrical power disconnect means can be any of a variety of well-known electrical power disconnection devices including, but not limited to, circuit breakers, which can include, but are not limited to, electronically, electrically, electro-mechanically, or pneumatically, operated breaker, relays, and/or switches. Preferably, the disconnect means is a simple, fails-open relay having a set of line contacts that are closed when the relay is energized; thereby, allowing electrical power to be sent to the dryer, and open when the relay is de-energized; thereby, disconnecting electrical power to the dryer. And, in the event the detector senses a fire, the detector will activate a portion of the response means that de-energizes the disconnect means relay and opens the line contacts, which, in turn, de-energizes the dryer. The disconnect means can also include, but is not limited to, a circuit breaker that trips in response to an output signal from the detector, which can trip the breaker by either becoming de-energized or energized in response to the "fire detected" trip condition signal from the detector. Preferably, in the present invention, the disconnect means is located between the dryer's power cord and the source of electrical power to the dryer; however, the disconnect means can be installed in any other suitable location including, but not limited to, the dryer enclosure and/or the main breaker box supplying electrical power to the dryer and/or to any of the other components receiving electrical power in the vicinity of the dryer. Thus, on detection of a fire, the fire detector will send a signal to the disconnect means that will break the source of power to the malfunctioning dryer; thereby, removing the electrical power to the heating unit and/or the dryer, which could suppress the continued combustion of the source of fuel to the fire. In the case of a gas-powered clothes dryers, the disconnect means can also include, but is not limited to, a normally closed solenoid valve(s), which would need to be energized to allow the flow of gas to the burner unit. In this case, the fire arrestor and/or the detector will disconnect the electrical power to the solenoid(s), which would de-energize the solenoid valve(s) closing them and stopping the flow of gas to the burner unit. Since the present invention can be used with either electric or gas dryers, and since most of the description is from the perspective of an electric dryer, whenever the terms "heater element" or "burner unit" are used herein, they can be construed as being interchangeable when the context of their usage warrants.

Figure 2:
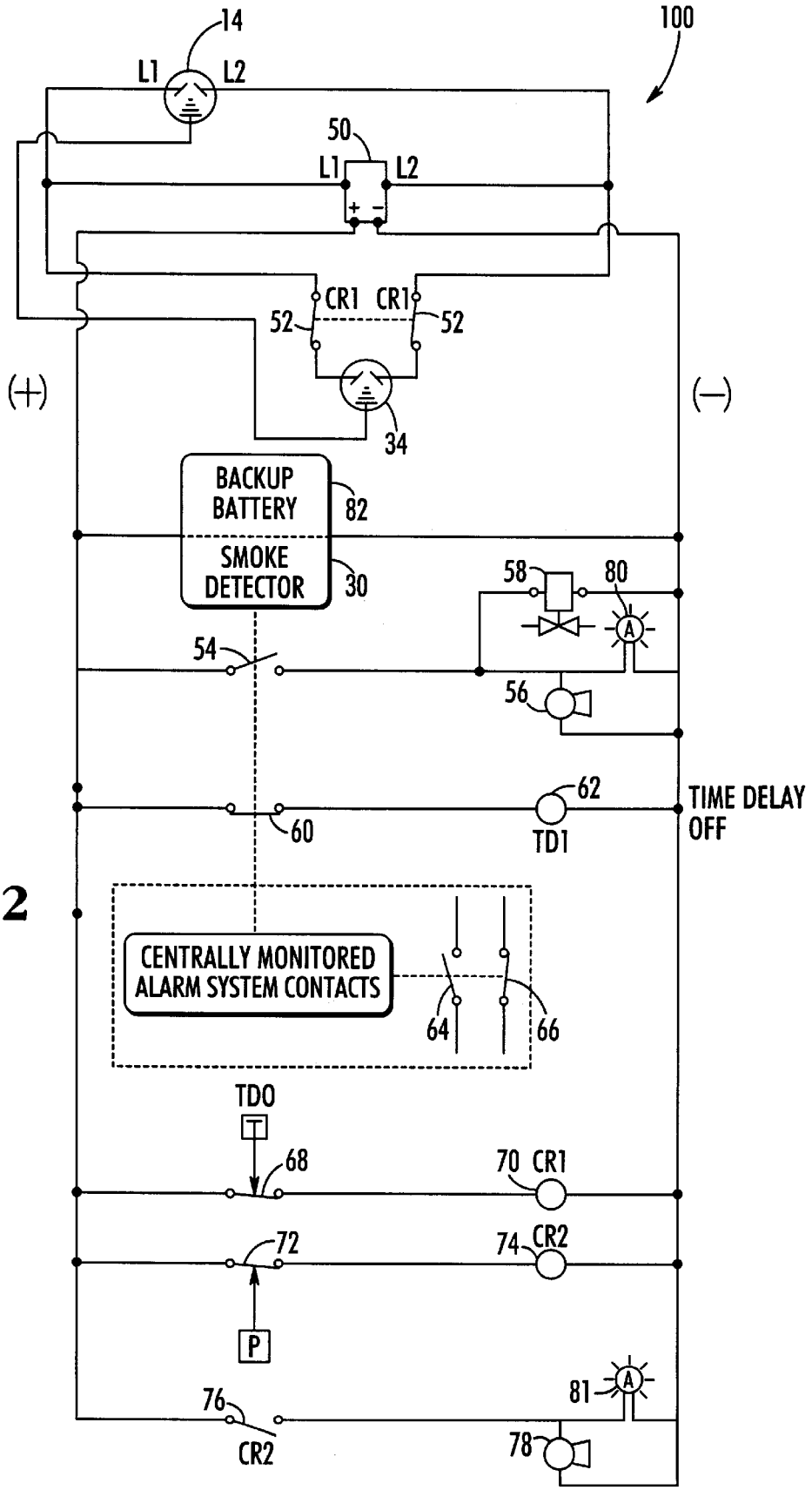
FIG. 2 is a schematic drawing of an example of a typical control circuit for use with the preferred embodiment of the present invention as shown in FIG. 1.

In an alternative embodiment, before the immediate disconnection of electrical power to the dryer or at least to the dryer blower (or fan) by the disconnect means, or concurrent with the immediate disconnection of electrical power to the dryer by the disconnect means, the signal from the fire detector can also activate an extinguishing means, which is another possible inclusion to the response means. Specifically, the detector signal in this embodiment is also used to activate the release of the contents of a carbon dioxide and/or any other suitable extinguishing agent canister into the dryer's air inlet, and thus into the interior of the dryer to suppress and/or possibly extinguish the fire (while, preferably, using the blower from the dryer to pull the carbon dioxide and/or the other extinguishing agent throughout the dryer's interior and into, and possibly through, its vent hose). (This time delay is preferably provided by using a time-delay means to de-energize the blower after a preselected period of time.) The canister can be located at any convenient location near the dryer, and the extinguishing agent is, preferably, carried by a tube from the canister to the dryer. A horn or tube can be fitted at the end of the tube in order to facilitate delivery of the extinguishing agent to the dryer's air inlet. Preferably, in association with the extinguishing means, a pressure switch 72 is used to sense the amount of the extinguishing agent remaining and/or the pressure of the contents of the canister 40, as shown in FIG. 2. Normally the pressure switch is held closed by the pressure and/or contents of the canister and, when a preselected value of pressure and/or contents level or weight is reached, the pressure switch opens causing a relay 74 to de-energize, which closes an alarm contact 76 energizing an audible alarm 78 and/or a visual alarm 81. In addition, this pressure switch 72, when opened, may also be used to de-energize the line contacts 52; thereby, removing electrical power to the dryer during low pressure and/or low contents conditions in the extinguishing means canister 40. Furthermore, the alarm used in connection with the pressure switch may be an additional audible alarm 78 separate from the audible alarm 56 used to signal a dryer fire. Similarly, the visual alarm 80 used to signal a dryer fire may be an additional alarm separate from the alarm 81 used with the pressure switch, as shown in FIGS. 1 and 2. However, the same audible and/or visual alarm can be used to provide an alarm signal for the dryer fire as well as the low pressure function.

Referring now to FIG. 1. Additionally, or alternatively, as previously mentioned, the carbon dioxide and/or other extinguishing agent can be released at the exhaust vent 6 of the dryer, directly into the air exhaust hoses 10 and/or 12. Preferably, however, the carbon dioxide and/or the other extinguishing agent is applied at the air inlet 4 to the dryer. The communications between the detector and the various response means (namely, the disconnect means, the extinguishing means, and/or the alarm means) can be provided by any standard hard-wired system, or through the use of any suitable wireless communications system including, but not limited to, those that employ the use of radio frequencies or other forms of electromagnetic radiation to communicate information.

As an example, but not as a limitation, as to how long the extinguishing agent should be introduced into the dryer, a typical dryer has an internal volume of approximately 27 cubic feet and circulates approximately 150 cubic feet of air per minute during normal usage; therefore, the entire average gas volume of the dryer is replenished every 10.8 seconds. Thus, under normal air flow condition, and assuming that only the extinguishing agent is being introduced into the dryer, a sustained introduction of extinguishing agent at the dryer air inlet for approximately 10 seconds should result in the gas volume of the dryer containing approximately 90% extinguishing agent. Likewise, a sustained introduction of extinguishing agent into the dryer for approximately 30 seconds should result in a gas volume of the dryer containing approximately 99.9% extinguishing agent.

While the present invention preferably uses carbon dioxide as the extinguishing agent, other nonflammable materials can be used as the extinguishing agent including, but not limited to, water, dry chemicals, halon substitutes, and/or other nonflammable gases, such as nitrogen and argon—all of which are preferably pressurized. With respect to these extinguishing agents, water is plentiful and, in general, its availability in the immediate proximity of a clothes dryer makes water a particularly attractive option for extinguishing fires. However, water is a less preferable agent for use with the present invention because most commercially available clothes dryers would require the retrofitting of spray nozzles, electrical equipment protection, and/or catch basins, as well as extensive plumbing, in order to effectively use water as the extinguishing agent. On the other hand, the use of water, preferably under pressure, is still a viable alternative for use with the present invention and, if used, the response means will be designed so that the electrical power to the dryer, and possibly to the other electrically powered components in the vicinity of the dryer, would be de-energized prior to activating the water-based extinguishing means to prevent possible electrical hazards.

Dry chemical extinguishing agents are also generally effective for fighting fires. However, their use in the present invention are less preferred because they have less efficient distribution properties when compared to gases. Furthermore, there may be substantial clean-up problems associated with the use of dry chemical agents to extinguish a fire in a clothes dryer.

Consequently, gaseous extinguishing agents are the most preferred options for the present invention. In such cases, no extensive plumbing is required. There will be no mess after discharge of the extinguisher, and nonflammable gases will not damage the dryer or its contents. Halon is an effective gaseous extinguishing material; however, it is less preferred than carbon dioxide because of environmental concerns and health risks associated with its use. However, acceptable halon substitutes are available including, but not limited to, IG-541, better known as INERGEN®, and HFC-227, commonly called FM-200®, and they may be used as the extinguishing agent in the present invention. Furthermore, both nitrogen gas and argon gas can serve as effective gaseous extinguishing materials; however, both are less preferred than carbon dioxide due to their increased expense, which is greatly increased in the case of argon gas, and their relatively limited availability to homeowners. Most preferably, carbon dioxide is used as the extinguishing material because of its commercial availability, relatively lower expense, and the aforementioned advantages of gaseous extinguishing materials. As a result, the present invention preferably uses, but is not limited to, carbon dioxide as the extinguishing agent for use to suppress and/or extinguish a dryer fire; however, as previously mentioned, water, and/or other extinguishing agents can be used as well.

Referring now to FIG. 1, there is shown generally a fire arrester 20 for use with a clothes dryer 2. The clothes dryer 2 is a typical, commercially-available clothes drying appliance having an air inlet 4, an exhaust vent 6, and a dryer power cord 8 terminated on one end with an electrical plug 9, which fits a standard dryer power supply outlet 14. In normal clothes dryer operation, air is expelled from the clothes dryer 2, through exhaust vent 6, and is channeled to the exterior of the home by exhaust hoses 10 and 12. The exhaust hose 10 and 12 is preferably fabricated of a relatively non-burnable metallic material, e.g., aluminum. The reason for this is that it has been determined that plastic, vinyl, and metal foil vent hoses, can directly and/or indirectly contribute fuel to a dryer fire. Preferably, the air from the dryer is directed from the exhaust vent 6 to the detector 30 through the proximal exhaust hose 10, and, after leaving the detector 30, the air is channeled through the distal exhaust hose 12, which preferably directs this exhaust air to the exterior of the home. It is also possible, however, to locate the detector 30 at the end of the exhaust path, or to have multiple detectors 30 located along the ventilation path including, but not limited to, locating the detectors 30 so that each detector 30 provides detection coverage for at least one section of the ventilation path. Preferably, however, the entire ventilation path is monitored from the dryer's air intake to the exterior vent. Also, with respect to having the detector 30 located at the end of the exhaust path, the detector 30 can be an integral part of the exhaust structure. For example, but not as a limitation, the detector 30 can be designed to be a part of, or to also act as, an exterior dryer exhaust vent hood (not shown), which is a commonly seen device attached to the end of a dryer's exhaust ducting on the outside of a building.

With reference to FIGS. 1 and 2, the detector 30 preferably is, or contains, a smoke detector (not shown) that contains at least one sensor that samples the exhaust air passing through the detector 30. The detector 30, however, is not limited to just using a smoke sensor, or a smoke sensor alone; for example, the detector may contain a variety of different types of sensors suitable for detecting the presence of a fire, either alone or in combination with other types. Detector 30 is supplied electrical power from the power supply outlet 14, which is normally 220–240 VAC, or from another electrical outlet, which can be a standard 110–120 VAC outlet, by means of the detector power cord 36. Since the types of plugs used with the different voltages have different configurations, the present invention can include an adaptor that can be used with the detector's electrical plug 37 to fit a standard outlet, or the present invention can include different detector power cords 36 having different electrical plugs 37 that are interchangeably attachable to the detector 30. Associated with this, the detector 30 may include a selector switch (not shown) that the user may need to operate to ensure that the different input voltages used with the detector 30 are adjusted for use with the detector's circuitry. Also, and preferably, a computerized selector switch may be used to automatically sample the input voltage and make an adjustment that modifies that voltage for proper operation of the detector 30. Preferably, detector 30 also carries a back-up battery 82 to power the fire arrestor in case of an electrical power failure. Associated with this, it is preferable that the back-up battery 82 is rechargeable and kept in a fully charged state during normal operation by the control circuit's low voltage power supply 50, shown in FIG. 2.

While still referring to both FIGS. 1 and 2, the operation of the fire arrester will be explained with reference to the typical electrical control circuit 100, which is shown in FIG. 2. While this is an example of a typical electrical control circuit 100, it is not a limitation to the present invention in that many variations may be made to the electrical control circuit 100 in order to provide the present invention's features and to accomplish the present invention's functions as described herein and as included within the scope of this description and of the appended claims. Additionally, the components shown and/or described with respect to the electrical control circuit 100 are of the type and design commonly found in the field of electrical control circuitry; therefore, a detailed description of their design, construction, and/or operation is unwarranted and is not included herein.

Detector 30 is in electrical communication with the disconnect means 34 by means of disconnect signal cord 32. Alternatively, detector 30 may communicate signals from its internal fire sensor to the disconnect means 34 by other means, including, but not limited to wireless communication means. As described above, the disconnect means 34 is preferably a normally open relay or a circuit breaker that is responsive to the output signal of the detector 30, and it serves to disconnect the electrical power to the clothes dryer 2 upon receipt of that output signal, which is activated by the smoke (and/or other type of) sensor within the detector 30. In other words, the output signal from the detector 30 acts as a trip signal for the disconnect means 34, and the disconnect means 34 may be configured so as to disconnect the power from the power supply outlet 14 and/or from any other source of power to the clothes dryer 2. Preferably, after receipt of a signal from the smoke (and/or other type of) sensor, and concurrent with the disconnection of electrical power to the dryer 2, the detector 30 closes contact 54, which energizes the audible alarm 56 (and/or visual alarm 80). Simultaneously with this, another preferred embodiment of the present invention uses the output signal from the detector 30 to close contact 64 and open contact 66, which causes a notification signal to be transmitted to a remote monitoring facility. As an example, but not as a limitation, the transmission of the remote monitoring signal is accomplished by having the output signal from the detector 30 also directed, either through hard-wiring or through wireless signal communication means, to a home monitoring service's interface, which is typically located within the home and/or building; however, any other suitable method can be used as well, including, but not limited to, an automatic dialer incorporated into a voice-messaging system that will dial and notify a remote facility, and/or others, of the fire.

In another embodiment, upon receipt of an output signal from the detector 30, and besides sounding an alarm, the output signal from the detector 30 also energizes the extinguisher's 40 solenoid valve 58, which causes the valve 58 to open, releasing extinguishing agent into the dryer 2 and/or into the dryer's exhaust vent 6 and/or exhaust hoses 10 and/or 12. In this preferred alternative embodiment of the present invention, the signal from the internal smoke sensor (and/or other type of sensor) and/or of the detector 30 is also routed to the fire extinguishing means. More specifically, the signal from smoke sensor (and/or other type of sensor) and/or the detector 30 is routed through the extinguisher cord 38 to the extinguisher 40. The extinguisher 40 is a canister containing pressurized nonflammable extinguishing agents. Preferably, the agent used is a compressed, i.e., pressurized, gas including, but not limited to, carbon dioxide ($CO_2$) and halon substitutes; however, any other suitable extinguishing agent can be used as well. Upon receipt of a signal from the sensor and/or the detector 30, extinguisher 40 releases the pressurized nonflammable extinguishing agent into the air inlet 4 of the clothes dryer 2 by way of the extinguisher tube 42. As a result, the nonflammable extinguishing agent is channeled through the airflow path of the clothes dryer 2 and is carried to the source of the smoke (or fire) that has been sensed by the detector 30. Additionally, as a back-up, the extinguisher 40 may have at least one manual operator (not shown) for manually initiating the release of the extinguishing agent into the dryer 2, and/or for initiating the other response means including, but not limited to, the activation of any remote alarms and/or the disconnection of electrical power to the dryer 2.

In another preferred embodiment, while the trip signal from the detector 30 will still cause the extinguishing agent to be released and the alarm(s) to be activated, the electrical power to the dryer 2 will not be immediately disconnected upon detection of a fire. Instead, the output signal from the detector 30 will open contact 60 which de-energizes the time delay relay 62 while allowing contact 68 to remain closed and the main power disconnect coil 70 to remain energized. This keeps the blower energized by maintaining the supply of electrical power to the dryer 2. However, once the time delay relay 62 times out, contact 68 opens, which de-energizes the main power disconnect coil 70, which in turn opens line contacts 52 completely de-energizing the dryer 2. Preferably, the time delay, which is a pre-selected amount of time, is pre-set into the time delay relay 62 and used to facilitate the movement of the extinguishing agent through the dryer 2, the exhaust vent 6 and/or the exhaust hoses 10 and 12, and/or the removal of the smoke from the dryer 2, the exhaust vent 6 and/or the exhaust hoses 10 and 12, by allowing the dryer's blower to continue operating for the pre-selected amount of time. Even more preferable is the use of an optional internal circuit (not shown) that can be either retrofitted, or installed during manufacture as a standard feature of the dryer. This optional internal circuit would open upon receipt of a trip signal activated by the smoke sensor (and/or other type of sensor) and/or the detector 30 and would simultaneously de-energize the optional time delay relay 62 (and other related contacts and/or components) to start the time delay, and the circuit would also immediately disconnect the power to the heater and/or burner unit; thereby, de-energizing the heater element in an electric dryer or closing the gas supply valves in the burner unit of a gas dryer, even while the blower is still operating. With the exception of having an extra set of contacts used to de-energize the heater and/or burner unit, this optional time delay circuit could be similar to the time delay relay 62 and/or its associated components and/or circuitry. For example, but not as a limitation, both designs could have time delay relay 62 and contacts 60, 68, and/or 52. Time delay relay 62 and contacts 60 and 68, as previously mentioned, would keep the line contacts 52 closed for a pre-selected period of time to keep the blower operating. This, as previously mentioned, is accomplished by keeping contact 68 closed and, therefore, the main disconnect relay 70 energized until the time period expires. After the time period expires, the time delay circuit 62 will cause contact 68 to open, which will consequently de-energize the main disconnect relay 70, which in turn will cause the line contacts 52 to open—completely de-energizing the main power to the dryer 2.

In an alternative embodiment of the present invention, the entire fire arrester 20 can be incorporated within the clothes dryer 2 during manufacture. Specifically, the components of the fire arrester corresponding to reference characters 30 through 82 can be located inside the clothes dryer 2. In this embodiment, the present invention is a clothes dryer having an incorporated fire arrester system. Additionally, since the backs of dryers are generally inaccessible and hard to clean, and since lint and other materials can be drawn into the dryer's air intake and into the heating element or burner, these can become a possible source of fuel that eventually ignites a fire; therefore, the functions and/or features of the fire arrester 20 may include the provision of dryer air intake vents (not shown) that are preferably located on the front, or top, of the dryer—making them more easily accessible for cleaning—and, preferably, will include a screen and/or other filter element that can be easily removed and cleaned.

Moreover, and preferably, each embodiment of the present invention will include a means for manually resetting the present invention fire arrester before reconnecting electrical power to the dryer 2 after the present invention fire arrester has been activated. This manual reset, however, while preferable is not required.

While the different features and functions of the present invention, as described herein, were described in the context of specific embodiments, these were for the purpose of describing the present invention and not as a limitation to the present invention. In this regard, any permutation of the different features and/or functions of the present invention, within the spirit and the scope of the description herein and/or within the spirit and scope of the claims appended hereto, can be considered to be combinations encompassed by the present invention. Moreover, those skilled in the art of appliance design and operation will see that many substitutions and modifications to the foregoing preferred embodiments are possible without departing from the spirit and scope of the preferred embodiments, as further defined by the following claims.

Table of Reference Characters (for the Convenience of the Examiner)

| | |
|---|---|
| clothes dryer | 2 |
| air inlet | 4 |
| exhaust vent | 6 |
| dryer power cord | 8 |
| electrical plug | 9 |
| proximal exhaust hose | 10 |
| distal exhaust hose | 12 |
| power supply outlet | 14 |
| fire arrester, generally | 20 |
| detector | 30 |
| disconnect signal cord | 32 |
| disconnect means | 34 |
| detector power cord | 36 |
| extinguisher cord | 38 |
| extinguisher | 40 |
| extinguisher tube | 42 |
| low voltage power supply | 50 |
| line power contacts | 52 |
| response means (local alarm and extinguisher) contacts | 54 |
| audible alarm | 56 |
| solenoid valve | 58 |
| contact | 60 |
| time delay relay | 62 |
| contact | 64 |
| contact | 66 |
| contact | 68 |
| main power disconnect coil | 70 |
| pressure switch | 72 |
| relay | 74 |
| alarm contact | 76 |
| audible alarm | 78 |
| visual alarm | 80 |

-continued

| Table of Reference Characters (for the Convenience of the Examiner) | |
|---|---|
| visual alarm | 81 |
| back-up battery | 82 |
| typical electrical control circuit | 100 |

What is claimed is:

1. A fire arrester kit for use with a clothes dryer having a ventilation path from an inlet to an outlet, said ventilation path having an internal volume, said dryer having a blower that forces air from said inlet to said outlet and a heat source, said fire arrester kit, comprising:

a fire detector adapted to be positioned at an outlet of a clothes dryer, said fire detector being adapted to detect a fire and to emit a signal when said fire is detected;

means for extinguishing a fire, said extinguishing means being adapted to be positioned at an inlet of said clothes dryer and responsive to said signal from said fire detector, said fire extinguishing means being adapted to extinguish a fire in a flow path of said dryer;

dryer de-energizing means for de-energizing a heat source and a blower of said dryer, said dryer de-energizing means being responsive to said signal from said fire detector; and means for delaying de-energizing said blower in response to said signal so that said blower assists said extinguishing means in extinguishing said fire.

2. The fire arrester kit as recited in claim 1, further comprising a non-flammable driver hose adapted for connection to said dryer.

3. The fire arrester kit as recited in claim 1, wherein said fire extinguisher means is a carbon dioxide extinguisher.

4. The fire arrester kit as recited in claim 1, wherein said delaying means includes a pressure sensor adapted to sense pressure in a flow path of said dryer, said delaying means de-energizing said blower when said pressure in said flow path reaches a pre-selected level.

5. The fire arrester kit as recited in claim 1, wherein said fire detector is a smoke detector.

6. A machine, comprising:

a clothes dryer having a flow path from an inlet to an outlet, and an interior volume, said dryer having a blower that forces air from said inlet to said outlet, and a heat source;

a fire detector positioned at said outlet of said clothes dryer, said fire detector being adapted to detect a fire and to emit a signal when said fire is detected;

means for extinguishing a fire, said extinguishing means being positioned at said inlet of said clothes dryer and responsive to said signal from said fire detector, said fire extinguishing means being adapted to extinguish a fire in said flow path of said dryer;

dryer de-energizing means for de-energizing said heat source and said blower of said dryer, said dryer de-energizing means being responsive to said signal from said fire detector; and means for delaying de-energizing said blower in response to said signal so that said blower assists said extinguishing means in extinguishing said fire.

7. The machine as recited in claim 6, further comprising a non-flammable dryer hose connection to said dryer.

8. The machine as recited in claim 6, wherein said fire extinguisher means is a carbon dioxide extinguisher.

9. The fire arrester kit as recited in claim 6, wherein said delaying means includes a pressure sensor adapted to sense pressure in said flow path of said dryer, said delaying means de-energizing said blower when said pressure in said flow path reaches a pre-selected level.

10. The fire arrester kit as recited in claim 6, wherein said fire detector is a smoke detector.

11. A machine, comprising:

a clothes dryer having a flow path from an inlet to an outlet, and an interior volume, said dryer having a blower that forces air from said inlet to said outlet,and a heat source;

a fire detector positioned at said outlet of said clothes dryer, said fire detector being adapted to detect a fire and to emit a signal when said fire is detected;

means for extinguishing a fire, said extinguishing means being positioned at said inlet of said clothes dryer and responsive to said signal from said fire detector, said fire extinguishing means being adapted to extinguish a fire in said flow path of said dryer;

dryer de-energizing means for de-energizing said heat source and said blower of said dryer, said dryer de-energizing means being responsive to said signal from said fire detector; and a filter means positioned near said inlet of said flowpath adapted to filter airborne material from said flowpath.

12. The machine as recited in claim 11, wherein said filter is adapted to be removable for cleaning.

* * * * *